United States Patent [19]

Baltz

[11] 4,230,085

[45] Oct. 28, 1980

[54] MANUAL STARTER FOR INTERNAL COMBUSTION ENGINES

[75] Inventor: Gene F. Baltz, Lake Villa, Ill.

[73] Assignee: Outboard Marine Corporation, Waukegan, Ill.

[21] Appl. No.: 3,702

[22] Filed: Jan. 15, 1979

[51] Int. Cl.[3] ..... F02N 3/02

[52] U.S. Cl. ..... 123/185 A; 123/185 B; 123/179 C; 123/179 SE

[58] Field of Search ..... 123/179 C, 179 SE, 179 J, 123/185 R, 185 A, 185 BA, 185 BB; 74/6

[56] References Cited

U.S. PATENT DOCUMENTS

| | | | |
|---|---|---|---|
| 1,127,710 | 2/1915 | Woods | 123/185 A |
| 2,373,507 | 4/1945 | Smith | 123/185 B |
| 2,927,571 | 3/1960 | Kamlukin | 123/179 SE |
| 3,626,937 | 12/1971 | Gjovik | 123/185 BB |
| 3,814,073 | 6/1974 | Nakatani | 123/185 A |

FOREIGN PATENT DOCUMENTS

| | | | |
|---|---|---|---|
| 1051828 | 12/1966 | United Kingdom | 123/179 SE |

*Primary Examiner*—P. S. Lall

*Attorney, Agent, or Firm*—Michael, Best & Friedrich

[57] ABSTRACT

The manual starter for an internal combustion engine includes a flexible pull element mounted in the vicinity of the engine flywheel for movement between a normally retracted position and an extended position and having teeth or cogs adapted to drivingly engage teeth provided on the outer peripheral surface of the flywheel. When the pull element is pulled to an extended position, a rocker arm cooperating with the pull element moves the pull element to a drive position wherein the cogs drivingly engage the flywheel teeth to effect starting rotation of the flywheel. When the pull element is released or the rotational speed of the flywheel exceeds the pulled speed of the pull element after the engine has started, the rocker arm permits the pull element to move from the drive position to a non-drive position wherein the cogs are drivingly disengaged from the flywheel teeth.

11 Claims, 3 Drawing Figures

MANUAL STARTER FOR INTERNAL COMBUSTION ENGINES

BACKGROUND OF THE INVENTION

This invention relates to starters for internal combustion engines and, more particularly, to manual starters for small internal combustion engines such as engines for outboard motors, lawn mowers and the like.

Manual starters for small internal combustion engines used in outboard marines, lawn mowers and the like typically include a pull rope wound onto a pulley connected to a worm drive carrying a starter pinion. When the pull rope is pulled, the starter pinion is moved axially by the worm gear and drives a starter gear, usually located on the engine flywheel, to start the engine. When released, the pull rope is wound back onto a pulley by a rewind or recoil spring. Such manual starters can be relatively expensive to manufacture and maintain because of the complexity and number of parts required. Also, the pulling force required for starting can be quite high because of system friction and the force required to unwind the rewind spring. Furthermore, the engine cranking speed tends to be somewhat less than would be possible for the same pulling force applied more directly to the engine crankshaft.

SUMMARY OF THE INVENTION

The invention provides a manual starter for internal combustion engines having a rotatable member operable to start the engine when rotated, which starter includes a drive member mounted for common rotation with the rotatable member and having a toothed portion, a flexible pull element mounted for movement between a normal retracted position and an extended position and having a cogged portion for drivingly engaging the drive member toothed portion, actuation means cooperating with the pull element for moving the pull element to a drive position wherein the cogged portion is releasably and drivingly engaged with the toothed portion of the drive member to effect starting rotation of the engine in response to the pull element being pulled from the retracted position to an extended position and for permitting movement of the pull element from the drive position to a non-drive position wherein the cogged portion is drivingly disengaged from the toothed portion of the drive member in response to the pull element being released or in response to the rotational speed of the drive member exceeding the pulled speed of the pull element, and retracting means for returning the pull element from an extended position to the retracted position. The retracting means preferably is an elastic member which is connected to one end of the pull element and is stretched when the pull element is pulled for starting.

In one embodiment, the actuation means includes a rocker arm mounted for pivotal movement relative to the pull element, first and second cam means carried on the respective opposite ends of the rocker arm for engaging the pull element, and spring means acting on the rocker arm to bias the first and second cam means in a direction away from the pull element, such that, when a pulling force is applied on the pull element, the first cam means is engaged by the pull element and causes pivotal movement of the rocker arm to move the second cam means into engagement with the pull element and thereby move the pull element to the drive position and such that, when the pulling force is released or the rotational speed of the drive member exceeds the pulled speed of the pull element, the second cam means permits movement of the pull element from the drive position to a non-drive position.

In one embodiment, the rocker arm includes a first part with one end carrying the first cam and the other end mounted for pivotal movement, a second part with one end carrying the second cam and the other end mounted for pivotal movement coaxially with the first part, and the spring means comprises a pair of torsion springs mounted coaxially with the common pivot axis of the first and second parts and each bearing against a respective one of these parts.

One of the principal features of the invention is a provision of a simplified, low cost manual starter for internal combustion engines.

Another of the principal features of the invention is the provision of a pull-type manual starter for an internal combustion engine, which starter is capable of providing improved engine cranking with minimum pull forces.

A further of the principal features of the invention is the provision of a manual starter for internal combustion engines, which starter includes a flexible pull element arranged to directly drive the engine flywheel or similar rotatable member drivingly connected to the engine crankshaft.

Other features and advantages of the invention will become apparent to those skilled in the art upon reviewing the following detailed description, the drawings and the appended claims.

Figure 1:
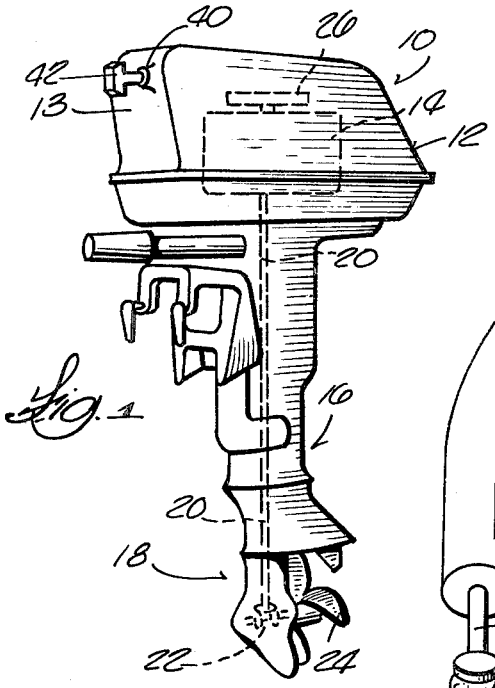
FIG. 1 is a perspective view of an outboard motor including a manual engine starter embodying various of the features of the invention.

Before explaining at least one embodiment of the invention in detail, it is to be understood that the invention is not limited in its application to the details of construction and the arrangements of the components set forth in the following description or illustrated in the drawing. The invention is capable of other embodiments and of being practiced or carried out in various ways. Also, it is to be understood that the phraseology and terminology employed herein is for the purposes of description and should not be regarded as limiting.

DESCRIPTION OF THE PREFERRED EMBODIMENTS

Illustrated in FIG. 1 is an outboard motor 10 including a power head 12 having a shroud 13 housing an internal combustion engine 14 and a lower unit 16 having a gearcase 18. Extending through the lower unit 16 and operably connected to the engine 14 is a drive shaft 20 (illustrated partially and schematically) which drives a propeller shaft 22 extending from the gearcase 18 and carrying, on the outer end thereof, a propeller 24. The engine 14 has a rotatable, circular flywheel 26 which is drivingly connected to the engine crankshaft (not shown) in the usual manner and is operable to start the engine when rotated.

Figure 2:
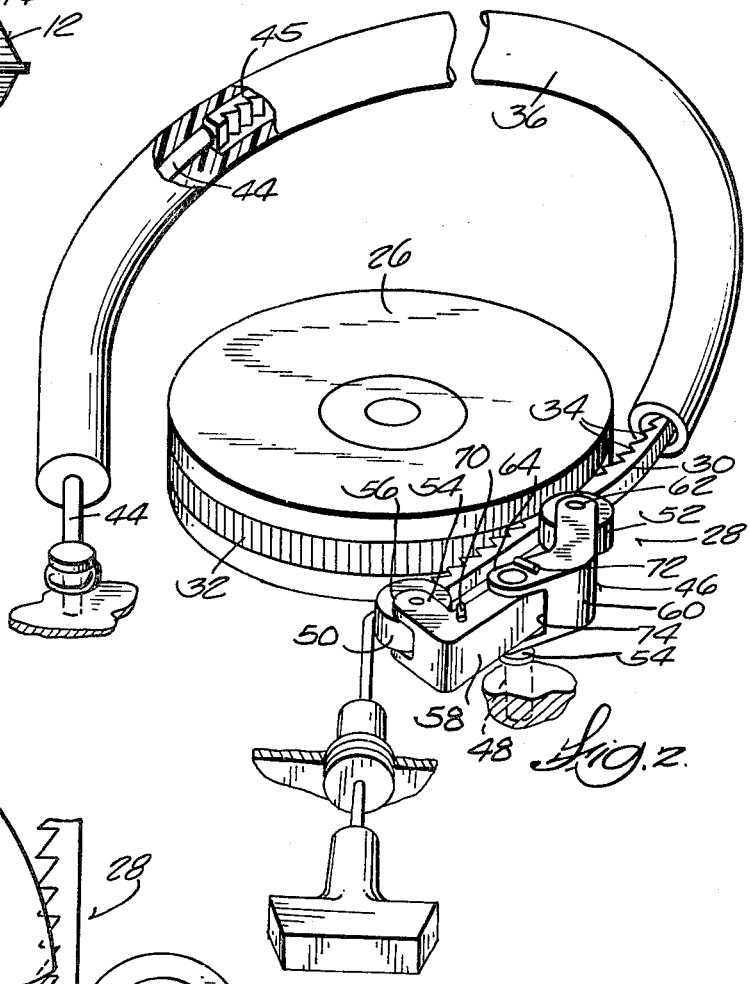
FIG. 2 is an enlarged, partially broken away, perspective view of various components of the starter incorporated in the outboard motor of FIG. 1, illustrating their locations prior to and after engine starting.
Figure 3:
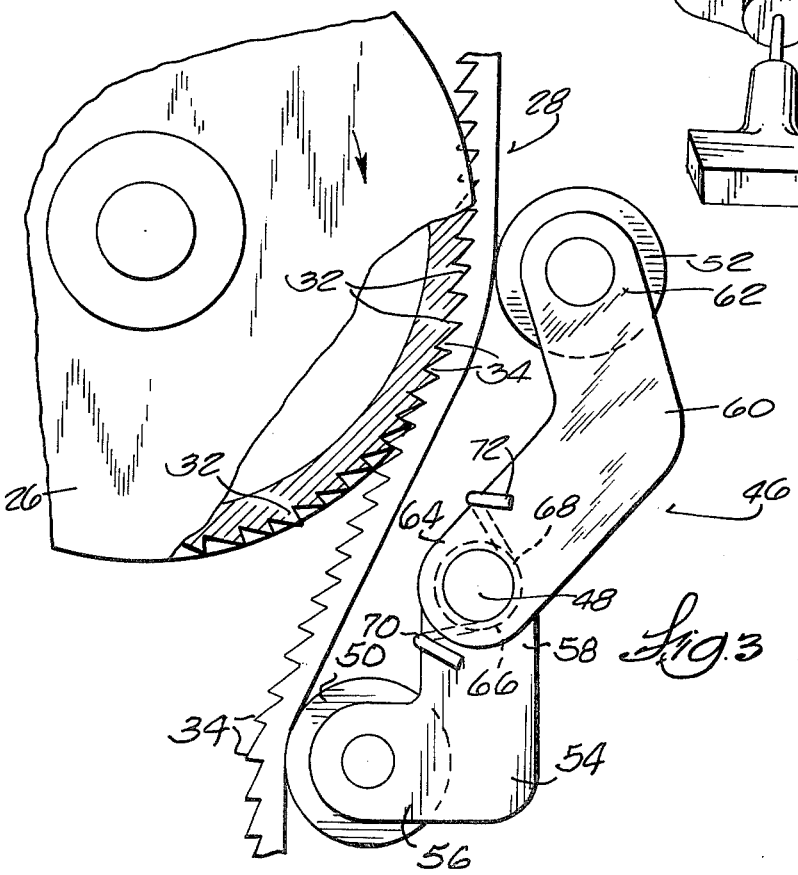
FIG. 3 is a fragmentary, partially broken away, top view of the engine starter of FIG. 2 illustrating the location of various components when the pull element has been pulled to start the engine.

Referring to FIGS. 2 and 3, the engine 14 is started by a manual starter system 28 including a flexible pull element 30 which is operable, upon being pulled, to drivingly engage and rotate the flywheel 26, or a similar rotatable member drivingly connected to the engine crankshaft to effect engine starting when rotated. More specifically, a plurality of circumferentially spaced, saw tooth-shaped teeth 32 are provided on the outer peripheral surface of the flywheel 26 and a portion of the pull element 30 has a plurality of complementary saw tooth-shaped teeth or cogs 34 which are meshable with the flywheel teeth 32. The pull element 30 is preferably in the form of a belt made from nylon or other suitable flexible material.

The pull element 30 is mounted for movement between a normally retracted position and a pulled out or extended position. While various suitable arrangements can be used, in the specific construction illustrated, the pull element 30 (FIG. 2) is slidably mounted in a tubular member or storage tube 36 which is located in the vicinity of the flywheel 26 and is arranged to guide the pull element 30 through an arcuate travel path. The outer or free end 38 of the pull element 30 does not include cogs, extends through a guide 40 in the shroud 13, and includes a pull handle 42.

Retracting means are provided for returning the pull element 30 to the retracted position. While various suitable means can be used for this purpose, in the specific construction illustrated, the retracting means (FIG. 2) includes an elastic member 44 having one end suitably connected to the inner end 45 of the pull element 30 and the other end anchored on the engine. The elastic member 44 is stretched as the pull element 30 is pulled to an extended position and retracts the pull element 30 inside the storage tube 36 to a retracted position as illustrated in FIG. 2 upon returning to a relaxed or normal condition.

Actuation means are provided for moving the pull element 30 to a drive position wherein the pull element cogs 34 are releasably and drivingly engaged with the flywheel teeth 32 to effect starting rotation of the flywheel 26 in response to the pull element 30 being pulled from the retracted position illustrated in FIG. 2 to an extended position illustrated in FIG. 3 and for permitting movement of the pull element cogs 34 to a non-drive position wherein the pull element cogs 34 are drivingly disengaged from the flywheel teeth 32 in response to the pull element 30 being released or in response to the rotational speed of the flywheel 26 exceeding the pulled speed of the pull element 30 when the engine is started. While various means can be used for this purpose, in the specific construction illustrated, the actuation means includes a rocker arm or arms 46 mounted on a stationary shaft or pin 48 for pivotal movement relative to the pull element 30 and to the flywheel 26, and rollers 50 and 52 carried on the outer ends of the rocker arm or arms 46 for engaging the pull element 30 and serving as cams as described below. Means are provided for biasing the rollers 50 and 52 in a direction away from the pull element 30.

In the specific construction illustrated, the rocker arm 46 includes a first part or arm 54 having a first or outer end 56 carrying the roller 50 and a second or inner end 58 pivotably mounted on the pin 48 and a second part or arm 60 having a first or outer end 62 carrying the roller 52 and a second or inner end 64 pivotably mounted on the pin 48 coaxially with the first arm 54.

Encircling the pin 48 is a pair of torsion springs 66 and 68, each having one end suitably anchored to the pin 48. The other end 70 of the spring 66 bears against the first arm 54 and biases it away from the pull element 30 while the other end 72 of the spring 68 bears against the second arm 60 and biases it away from the pull element 30. The inner end 64 of the second arm 60 has a stop or shoulder 74 which is spaced from the inner end 58 of the first arm 54 when the two arms are in their normal positions illustrated in FIG. 2.

In operation, when the pull element 30 is in a normally retracted position, the pull element cogs 34 are drivingly disengaged from the flywheel teeth 32. When an operator initially pulls on the pull handle 42, a portion of the pull element 30 engages the roller 50, causing pivotal movement of the first arm 54 in a counterclockwise direction as viewed in FIG. 3. As the first arm 54 is pivoted, the inner end 58 of the first arm 54 engages the second arm shoulder 74 and the second arm 60 is thereafter pivoted in a counterclockwise direction to override the biasing force of the spring 68 and to move the roller 52 into engagement with another portion of the pull element 30 and to apply to the pull element 30 a force acting generally radially of the flywheel 26 so as to displace or cam the pull element cogs 34 into driving engagement with the flywheel teeth 32 and thereby effects starting rotation of the flywheel 26 (in a clockwise direction as viewed in FIG. 3) during continued pulling on the pull handle 42 as the elastic member 44 is stretched.

When the operator releases the pull handle 42, the torsion spring 68 returns the first arm 60, and thus the roller 50, toward a normal position wherein the pull element cogs 34 are drivingly disengaged from the flywheel teeth 32 as the elastic member 44 returns the pull element 32 to the retracted position inside the storage tube 36. When the engine is started while the pull element 30 is still being pulled and the flywheel 26 begins to rotate faster than the pulled speed of the pull element 30, the flywheel teeth 32, acting on the pull element cogs 34, generate an outward radial force on the pull element 30 against the camming force of the roller 52. This force is sufficient to drivingly disengage the pull element cogs 34 from the flywheel teeth 32.

From the above description, it can be seen that the starter system provided by the invention, in comparison to conventional manual starters, requires fewer parts and, therefore, is less expensive to manufacture and maintain, is capable of being operated with substantially less pulling force because a recoil or rewind spring and other friction-generating components are not required, and is capable of providing improved engine cranking because of a more direct driving connection with the engine flywheel.

Various of the features of the invention are set forth in the following claims.

What is claimed is:

1. A manual starter for an internal combustion engine, said starter including a drive member mounted for rotation, operable to start the engine when rotated, and having a toothed portion, a flexible pull element mounted for movement between a normally retracted position and an extended position and having a flexible cogged portion for drivingly engaging said drive member toothed portion, movable actuation means operable in response to movement of said pull element for applying a force acting radially of said rotatable drive member and against said cogged portion so as to displace said pull element into a drive position wherein said pull element cogged portion is releasably and drivingly engaged with said drive member toothed portion to effect starting rotation of said engine in response to said pull element being pulled from the retracted position to an extended position and for permitting movement of said pull element from the drive position to a non-drive position wherein said pull element cogged portion is drivingly disengaged from said drive member toothed portion in response to said pull element being released or in response to the rotational speed of said drive member exceeding the pulled speed of said pull element, and retracting means for returning said pull element from an extended position to the retracted position.

2. A manual starter according to claim 1 wherein said drive member comprises a circular flywheel having an outer peripheral surface including a plurality of circumferentially spaced saw tooth-shaped teeth and wherein said pull element cogged portion includes a plurality of complementary cogs which are meshable with said flywheel teeth.

3. A manual starter according to claim 1 wherein said pull element has an inner end and a free end which is pulled by an operator and wherein said retracting means comprises an elastic member which is connected to said inner end of said pull element and is stretched when said pull element is pulled.

4. A manual starter according to claim 3 including guide means slidably receiving said inner end of said pull element for guiding movement of said pull element between the retracted and extended positions.

5. A manual starter according to claim 4 wherein said guide means comprises a tubular member forming an arcuate housing for said pull element.

6. A manual starter for an internal combustion engine, said starter including a drive member mounted for rotation, operable to start the engine when rotated, and having a toothed portion, a flexible pull element mounted for movement between a normally retracted position and an extended position and having a cogged portion for drivingly engaging said drive member toothed portion, actuation means cooperating with said pull element for moving said pull element to a drive position wherein said pull element cogged portion is releasably and drivingly engaged with said drive member toothed portion to effect starting rotation of said rotatable member in response to said pull element being pulled from the retracted position to an extended position and for permitting movement of said pull element from the drive position to a non-drive position wherein said pull element cogged portion is drivingly disengaged from said drive member toothed portion in response to said pull element being released or in response to the rotational speed of said drive member exceeding the pulled speed of said pull element, said actuation means including a rocker arm mounted for pivotal movement relative to said pull element and having first and second opposite ends, first and second cam means respectively carried on said opposite ends of said rocker arm for engaging said pull element, and spring means acting on said rocker arm to bias said first and second cam means in a direction away from said pull element such that, when a pulling force is applied on said pull element, said first cam means is engaged by said pull element and causes pivotal movement of said rocker arm to move said second cam means into engagement with said pull element and thereby move said pull element to the drive position, and such that, when a pulling force is released from said pull element or when the rotational speed of said drive member exceeds the pulled speed of said pull element, said second cam means permits movement of said pull element from the drive position to a non-drive position, and retracting means for returning said pull element from an extended position to the retracted position.

7. A manual starter for an internal combustion engine, said starter including a drive member mounted for rotation, operable to start the engine when rotated, and having a toothed portion, a flexible pull element mounted for movement between a normally retracted position and an extended position and having a cogged portion for drivingly engaging said drive member toothed portion, actuation means cooperating with said pull element for moving said pull element to a drive position wherein said pull element cogged portion is releasably and drivingly engaged with said drive member toothed portion to effect starting rotation of said rotatable member in response to said pull element being pulled from the retracted position to an extended position and for permitting movement of said pull element from the drive position to a non-drive position wherein said pull element cogged portion is drivingly disengaged from said drive member toothed portion in response to said pull element being released or in response to the rotational speed of said drive member exceeding the pulled speed of said pull element, said actuation means comprising a rocker arm including a first part having a first end carrying first cam means and a second end mounted for pivotal movement, said rocker arm further including a second part having a first end carrying second cam means and a second end mounted for pivotal movement coaxially with said first part, and spring means comprising first and second torsion springs mounted coaxially with the pivot axis of said first and second parts and respectively acting on said first and second parts to bias said first and second cam means in a direction away from said pull element, and retracting means for returning said pull element from an extended position to the retracted position.

8. A manual starter for an internal combustion engine including a circular flywheel having an outer peripheral surface, said starter including a toothed portion on the outer peripheral surface of the flywheel, a flexible pull element mounted for movement between a normally retracted position and an extended position, said pull element having a free end for pulling and a cogged portion for drivingly engaging said flywheel toothed portion, retracting means for returning said pull element from an extended position to the retracted position, a rocker arm mounted for pivotal movement relative to said pull element and having opposite ends respectively carrying first and second cam means for engaging said pull element, and spring means acting on said rocker arm to bias said first and second cam means in a direction away from said pull element, such that, in response to an operator pulling said pull element from the retracted position to an extended position, said first cam means is engaged by said pull element and causes pivotal movement of said rocker arm to move said second cam means into engagement with said pull element, and thereby move said pull element cogged portion into releasable driving engagement with said flywheel toothed portion to effect starting rotation of the flywheel, and such that, in response to the operator releasing said pull element or in response to the rotational speed of the flywheel exceeding the pulled speed of said pull element, said second cam means permits said pull element cogged portion to drivingly disengage from said flywheel toothed portion.

9. A manual starter according to claim 8 wherein said rocker arm includes a first part having a first end carrying said first cam means and a second end mounted for pivotal movement and further includes a second part having a first end carrying said second cam means and a second end mounted for pivotal movement coaxially with said first part, and wherein said spring means comprises first and second torsion springs mounted coaxially with the pivot axis of said first and second parts, each respectively acting on said first and second parts to bias said first and second cam means in a direction away from said pull element.

10. A manual starter according to claim 9 wherein said retracting means comprises an elastic member which is connected to the other end of said pull element and is stretched when the free end of said pull element is pulled by the operator.

11. A manual starter according to claim 10 including a tubular member slidably receiving said pull element and forming an arcuate travel path through which said pull element is guided during movement between the retracted and extended positions.

* * * * *